United States Patent [19]

Valle Arizpe

[11] Patent Number: 4,463,484

[45] Date of Patent: Aug. 7, 1984

[54] COFFIN, VAULT AND MAUSOLEUM MODULE COMBINATION

[76] Inventor: Fernando Valle Arizpe, 4a Calleo 47, Zona 10, Guatemala City, Guatemala

[21] Appl. No.: 417,431

[22] Filed: Sep. 15, 1982

[30] Foreign Application Priority Data

Feb. 17, 1982 [GT] Guatemala ..... 73910

[51] Int. Cl.[3] ..... A61G 17/00

[52] U.S. Cl. ..... 27/2; 52/137

[58] Field of Search ..... 27/1, 2, 11, 14, 15, 27/35; 52/131, 132, 130, 133, 134, 135, 136, 137, 138, 141

[56] References Cited

U.S. PATENT DOCUMENTS

| | | | |
|---|---|---|---|
| 304,101 | 8/1884 | Hatcher | 27/14 |
| 1,237,823 | 8/1917 | Rothenberger | 52/130 |
| 1,340,656 | 5/1920 | Hughes et al. | 52/134 X |
| 1,691,568 | 11/1928 | Gorman | 52/131 |
| 1,964,234 | 6/1934 | Vogel | 52/137 X |
| 2,783,523 | 3/1957 | Halley | 52/131 X |
| 4,277,924 | 7/1981 | Chimentin | 52/136 |

FOREIGN PATENT DOCUMENTS

| | | | |
|---|---|---|---|
| 2059547 | 6/1972 | Fed. Rep. of Germany | 52/135 |

*Primary Examiner*—Robert A. Hafer
*Assistant Examiner*—William H. Honaker

[57] ABSTRACT

A coffin for properly displaying and transporting a corpse is combined with features of a burial vault or crypt so that only the single unit is needed to inter the corpse. The coffin-vault combination, although inexpensively thin walled, is constructed in such a manner, with particular reinforcing and interlocking means, that numerous units may be stacked, one above another, above or below ground. When above ground they may constitute modules for constructing a mausoleum. Each unit has valves which may be connected to conduits and fluid and gas control units for the single unit, or a column, or columns of units constituting an entire mausoleum.

5 Claims, 9 Drawing Figures

COFFIN, VAULT AND MAUSOLEUM MODULE COMBINATION

BACKGROUND OF THE INVENTION

In recent years there has been a spate of books and articles about the high cost of dying. Although there are various manners of interment dictated by religious, nationalistic and class differences, in a general way it may be said that a corpse is placed in a coffin or casket which is often padded and cloth lined on the inside and decorated outside. There are often handles which may be removeable and the cover may be capable of being opened in part or in its entirety for viewing the body, and/or a small door in the cover may be over a glass section or other transparency.

The sealed coffin is taken to the cemetery where it may be lowered into a grave which is lined with slabs of concrete or similar impervious material, constituting a crypt or vault for protecting the comparatively fragile coffin. The crypt or vault may be kept above ground usually in a family mausoleum or large public mausoleum where many crypts may be kept in tiers or other arrangements.

When a body decomposes (this process may be slowed or delayed by expensive embalming) it gives off liquids and gasses which must be controlled or the coffin and vault will leak malodorous gases into the atmosphere or mausoleum.

As is well known, the cost of burial land has become increasingly quite prohibitively expensive and particularly as a fairly large vault is required around the coffin, either under the ground or above, in a mausoleum, quite a lot of ground is required.

To decrease expenses, coffin-crypts have been proposed. It is also known to utilize crypts in a modular fashion to create a mausoleum.

DESCRIPTION OF RELATED ART

U.S. Pat. No. 3,938,287 shows a mausoleum made of concrete modules comprising vaults for receiving coffins. U.S. Pat. No. 3,945,094 shows a vault containing a coffin having fluid control. U.S. Pat. No. 3,230,674 shows coffin receiving vaults stacked one upon the other using tongue and groove connections. U.S. Pat. No. 4,128,981 shows a reinforced concrete vault. U.S. Pat. No. 729,921 shows a vault reinforced in the vertical direction, but no stacking is intended or possible. U.S. Pat. Nos. 3,964,140 and 3,435,494 show a coffin fluid control, U.S. Pat. No. 2,705,828 shows a vault fluid control, U.S. Pat. No. 1,189,203 shows a mausoleum fluid control, U.S. Pat. No. 619,929 shows a burial gas burner.

OBJECTS AND SUMMARY OF THE INVENTION

The principal object of this invention is to provide a single unit coffin-vault which is particularly constructed to comprise a module in a mausoleum.

Another object of this invention is to construct such a unit with comparatively thin, inexpensive walls, but with reinforcements and interlocking features so fabricated, arranged, and located that there is sufficient strength to support a stack of up to eight or more units, either below the ground or comprising the walls of a mausoleum.

Another object of the invention is to utilize a single wall, instead of the successive walls of a coffin within a vault, so that the least amount of earth space is required for each corpse and/or the greatest amount of corpses may be contained in a given mausoleum.

Another object of the invention is to provide in a single unit all the necessary features and advantages of a coffin, a vault, and a mausoleum, so that a dignified burial may be had for least cost and low upkeep expense.

These and other objects of the invention may be deduced when the following drawings and descriptions are considered.

DETAILED DESCRIPTION OF THE PREFERRED EMBODIMENT

Figure 1:
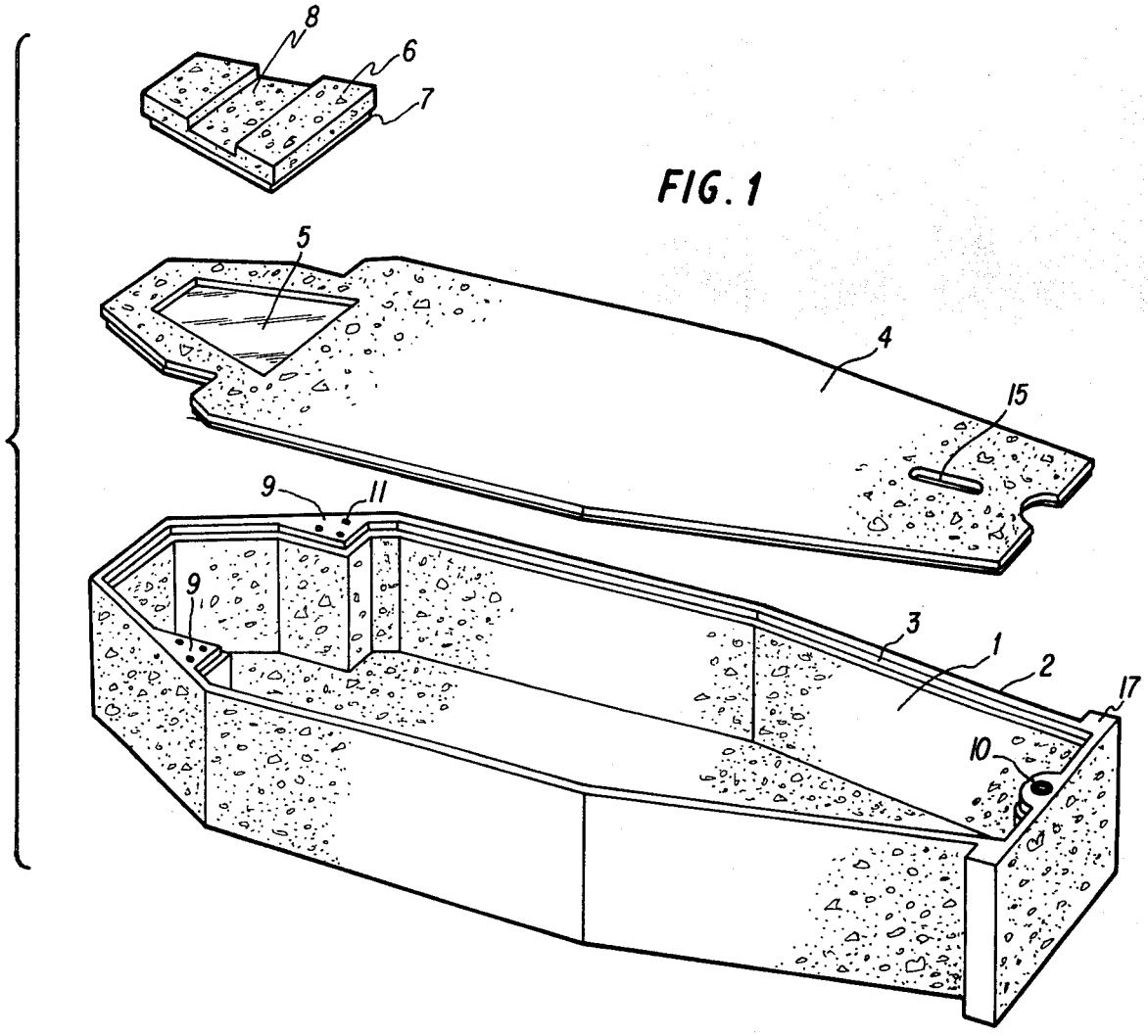
FIG. 1 is an exploded perspective view of the coffin-vault and cover.
Figure 8:
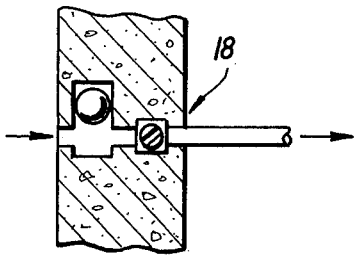
FIG. 8 is a schematic cross-section showing gas valve and outlet.
Figure 9:
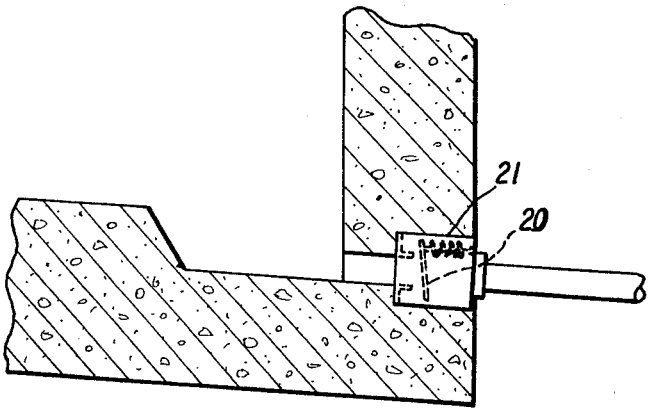
FIG. 9 is a schematic cross-section showing the fluid outlet.
Figure 2:
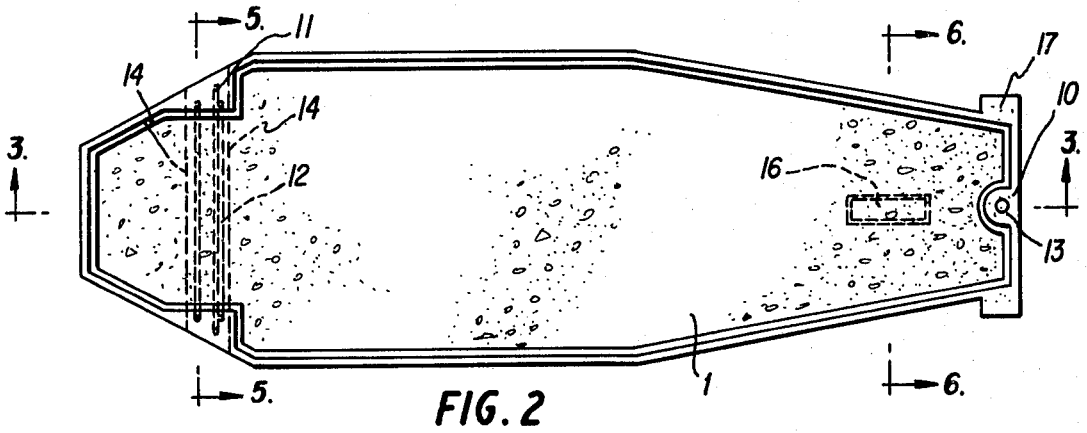
FIG. 2 is a top plan view of the coffin-vault.
Figure 3:
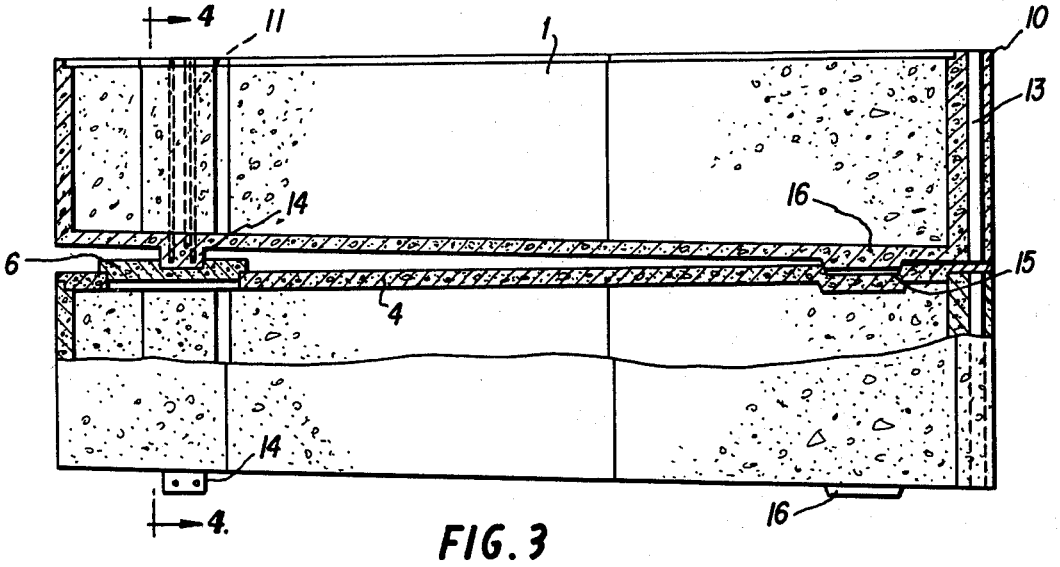
FIG. 3 is a side elevational view, partly in cross-section taken along line 3—3 of FIG. 2 showing how units are stacked.
Figure 5:
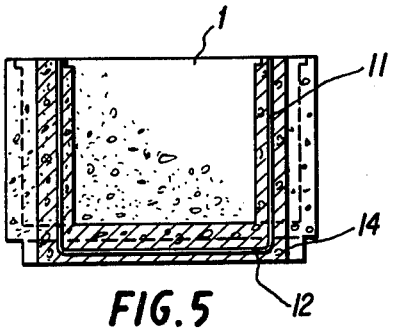
FIG. 5 is a cross-section taken along line 5—5 of FIG. 2.
Figure 4:
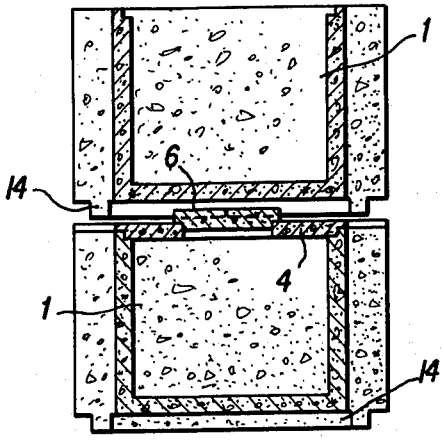
FIG. 4 is a cross-section taken along line 4—4 of FIG. 3.
Figure 6:
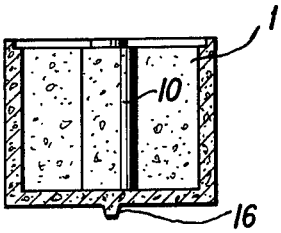
FIG. 6 is a cross-section taken along line 6—6 of FIG. 2.
Figure 7:
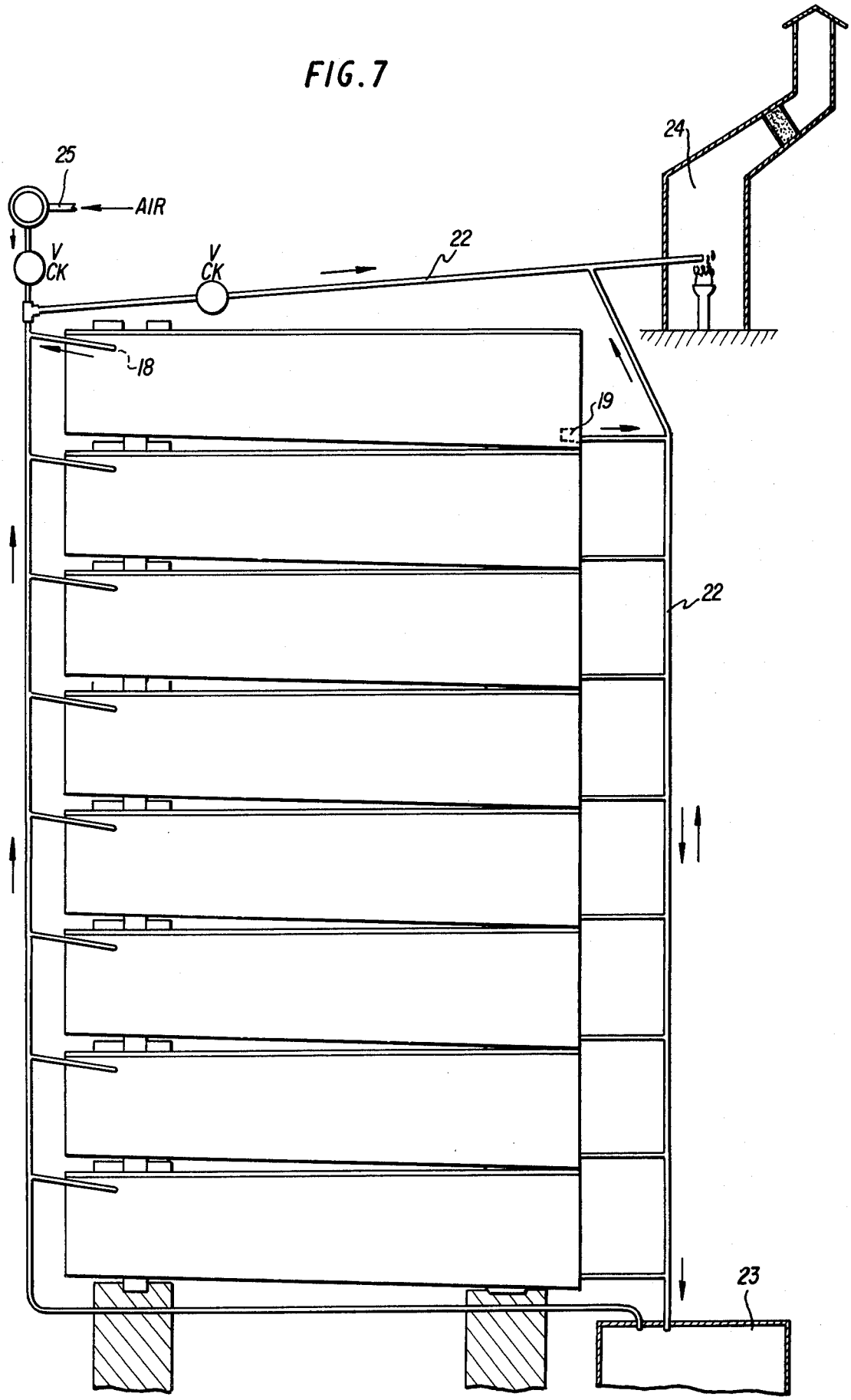
FIG. 7 is a side elevation of typical stack of coffin-vaults forming a portion of a mausoleum.

Referring now to FIG. 1, the coffin-vault 1 has thin walls 2 having a rebate 3 about the entire circumference of the coffin-vault for receiving the cover 4. This cover includes a window 5 of glass or other transparent material. It will be understood that the inside of the coffin-vault may be padded and/or cloth lined, as desired, for decorative purposes. Of course, the outside may also be decorated. When viewing of the corpse is completed, a small corner portion 6 is inserted over the glass. Rebate 7 makes a tight fit. A slot 8 is provided for a purpose to be described. The widened portions 9 and 10 will now be described with reference also to FIGS. 2 and 3. Three U-shaped steel rods 11 have their legs within the said widened portions 9 and their webs 12 within the bottom wall of the coffin vault. The widened portion 10 has a hollow steel tube 13 filled with concrete. The three U-shaped rods 11 and the hollow tube 13 are reinforcing members. They serve to cause the three widened portions 9 and 10 of the coffin-vault walls to be very strong in the vertical direction. The bottom wall of the coffin-vault has a depending beam or tongue portion 14 best seen in FIGS. 3 and 5 and in broken lines in FIG. 2. It will be seen best in FIG. 3 that the tongue 14 fits within the slot 8 of the cover portion 6. As best seen in FIG. 2, the said tongue 14 reinforced by webs 12 of rods 11, also rest on top of hardened wide portions 9. At the other end, wide portion 10, reinforced by tube 13 is supported by the similar wide portion of the coffin-vault below. The cover 4 has a slot 15 for receiving a tongue 16 depending from the bottom wall of a coffin-vault stacked above. The bottom wall of each coffin is sloped downwardly from head to foot for drainage purposes to be described below. It will now be understood that, when in stacked formation, each coffin-vault rests, at its head, on the hardened depending beam 14, and at its foot, across the entire rear area including thick portions 17. The fluid control system will now be described with particular reference to FIGS. 7, 8 and 9. FIG. 7 shows a stack of 8 coffin-vaults. Each vault has a gas control valve 18 seen in greater detail in FIG. 8, and a liquid control valve seen in greater detail in FIG. 9. Decomposition fluids will flow to the foot and exit through the valve door 20, opened by decomposition gases against coil spring 21. When decomposition gases increase in pressure, they may exit through valve 18. FIG. 7 also shows a system of conduits 22, a septic tank 23 and a gas burner 24, which may be connected to a stack of coffin-vaults. As liquids and gases exit from valve 19 the liquids descend to the septic tank and the gases rise to be burned at 24. When gas pressure becomes high it may exit valve 18 for burning at 24. High pressure air at 25 may be backed through the system when it is necessary to free valve door 20 when it becomes stuck due to congealing liquids as often happens.

Detachable handles as well known, not shown, may be utilized.

Having described my invention, I claim:

1. A coffin, vault, and mausoleum module combination comprising a generally coffin shaped structure having bottom, wall, and top lid structure, portions of the wall being free and uncovered by the lid structure and reinforced to be particularly resistant to compressive forces in the vertical direction, the bottom having depending tongue structure and the lid structure having groove structure for receiving the tongue structure of the module above when the modules are stacked, the lid structure comprising a cover with a window and a longitudinal groove said longitudinal groove being greater in length in the longitudinal direction of the cover than in the direction perpendicular thereto, a second cover for closing the window said second cover having a horizontal groove which extends perpendicular to the longitudinal groove, the depending tongue structure fitting in to the said horizontal groove and lying above the reinforced side portions, said bottom including further depending tongue structure in the longitudinal direction for fitting into the said longitudinal groove.

2. A module as in claim 1, the reinforcing structure including a plurality of generally U-shaped rods having web portions imbedded in the bottom depending tongue structure and side portions imbedded in opposite walls.

3. A module as in claim 2, the reinforcing structure further including a hollow reinforcing rod vertically imbedded in another portion of the wall, the bottom of each module being sloped from head to foot, the reinforced tongue supporting the head portion so that it is generally clear of the module below and the portion including the hollow vertical rod is at the module below.

4. A module as in claim 1 further including fluid control system valves and conduits which may be connected to a master system of funereal liquid and gas waste disposal when the modules are in stacked relationship.

5. A module as in claim 4 the fluid control system comprising a liquid and gas control system having a valve door including a coil spring and means for increasing pressure within the system when the valve is stuck closed because of congealing of the liquid.

* * * * *